United States Patent [19]

Daniels

[11] Patent Number: 4,745,249

[45] Date of Patent: May 17, 1988

[54] PACKAGE AND METHOD FOR MICROWAVE HEATING OF A FOOD PRODUCT

[75] Inventor: James A. Daniels, Plymouth Meeting, Pa.

[73] Assignee: Mrs. Paul's Kitchens Inc., Philadelphia, Pa.

[21] Appl. No.: 16,531

[22] Filed: Feb. 19, 1987

[51] Int. Cl.[4] ..... H05B 6/80

[52] U.S. Cl. ..... 219/10.55 E; 219/10.55 F; 219/10.55 R

[58] Field of Search ..... 219/10.55 E, 10.55 F, 219/10.55 R

[56] References Cited

U.S. PATENT DOCUMENTS

| | | | |
|---|---|---|---|
| 4,013,798 | 3/1977 | Goltsos | 426/107 |
| 4,027,132 | 5/1977 | Levinson | 219/10.55 |
| 4,096,948 | 6/1978 | Kuchenbecker | 206/622 |
| 4,122,324 | 10/1978 | Falk | 219/10.55 E |
| 4,190,757 | 2/1980 | Turpin et al. | 219/10.55 E |
| 4,228,945 | 10/1980 | Wysocki | 229/30 |
| 4,230,924 | 10/1980 | Bradstad et al. . | |
| 4,260,060 | 4/1981 | Faller | 219/10.55 E |
| 4,345,133 | 8/1982 | Cherney et al. | 219/10.55 E |
| 4,427,706 | 1/1984 | El-Hag | 426/243 |
| 4,529,089 | 7/1985 | Gasbarra et al. | 206/525 |
| 4,553,010 | 11/1985 | Bohrer et al. | 219/10.55 E |
| 4,555,605 | 11/1985 | Brown et al. | 219/10.55 E |
| 4,590,349 | 5/1986 | Brown et al. | 219/10.55 E |
| 4,592,914 | 6/1986 | Kuchenbecker | 426/107 |
| 4,594,492 | 6/1986 | Maroszek | 219/10.55 E |
| 4,612,431 | 9/1986 | Brown | 219/10.55 E |
| 4,626,641 | 12/1986 | Brown | 219/10.55 E |
| 4,641,005 | 2/1987 | Seiferth | 219/10.55 E |

OTHER PUBLICATIONS

Judy Rice, "Microwave Susceptors Control Energy Absorption Rates", Jun. 1986, Food Processing, p. 74.

Judy Rice, Mar. 1987, Food Processing, pp. 54–64.

*Primary Examiner*—A. D. Pellinen

*Assistant Examiner*—Leon K. Fuller

*Attorney, Agent, or Firm*—Banner, Birch, McKie & Beckett

[57] ABSTRACT

A method and package assembly for retailing and microwave heating of a breaded food product is provided. The package assembly includes a container with an interior surface composed of a microwave interactive material. The container bottom has inlet air openings and the container top has outlet air openings therein. The container also has a support member for supporting the food product in order to minimize the degree of contact between the food product and the container and the support member. The container is adapted to rest on an exterior packaging sleeve whereby a generally verticle air flow pathway is provided through the container to promote convection heating and crisping of the breaded surface portion of the food product during microwave heating.

19 Claims, 2 Drawing Sheets

PACKAGE AND METHOD FOR MICROWAVE HEATING OF A FOOD PRODUCT

BACKGROUND OF THE INVENTION

1. Field of the Invention

The present invention relates to a method and package for heating a food product in a microwave oven and in particular to a method and package for microwave heating of a breaded or battered food product.

2. Description of the Prior Art

In recent years, the number of homes containing microwave ovens has grown dramatically. This has resulted in an associated growth in the demand for microwave compatible prepared foods, especially frozen foods such as pies, pizzas, breaded or battered fish fillets, breaded or battered fish sticks, breaded or battered chicken fillets, vegetable and meat tempuras and the like.

However, various problems occur when this type of food product is heated in a microwave oven. Food products such as battered and breaded fish or chicken pieces can contain as much as 80% water. During microwave heating, the water in the product absorbs the bulk of the radio frequency energy causing rapid internal heating of the food product. Under the rapid heating conditions in a microwave oven, the water has a tendency to become vaporized and mobile. In conventional ovens, wherein the food is heated by hot gases within the oven (convection heating) or by heat radiating from the oven heating elements and walls (radiant heating), the surface of the heated food is much hotter than the interior of the food and any water or water vapor reaching the surface of the food will be removed by evaporation or carried away by the warm air flows in the oven, thereby providing the food product surface with a drier "crisp" texture.

However, upon heating moist foods with a breaded or battered coating, in a microwave oven, the interior of the food is raised to a much higher temperature than the surface of the food product, since the surface is exposed to the unheated ambient air in the microwave oven. Accordingly, the water vapor generated in the interior of the food product during microwave heating has a tendency to condense on the cooler breaded or battered surface portion, making it moist and soggy, rather than crisp as in a conventional oven.

In response to these problems, the art has provided vent openings in microwave heating containers so as to facilitate removal of water vapor from the container. Patents which disclosed the use of cartons having vent openings include U.S. Pat. Nos. 4,260,060 to Faller; 4,355,757 to Roccaforte; 4,096,948 to Kuchenbecker; 4,567,341 to Brown; and 4,228,945 to Wysocki.

Elevation of the food product container above the supporting surface of the microwave oven has also been attempted in order to promote venting of water vapor from the food product during microwave heating. Patents describing elevating the food product container above the supporting surface of the microwave oven in order to promote ventilation include U.S. Pat. Nos. 4,260,060 to Faller; 4,355,757 to Roccaforte; 4,096,948 to Kuchenbecker; and 4,228,945 to Wysocki.

Because most microwave heating containers are transparent to microwave energy, they (like the ambient air in the microwave oven) are not heated by the microwave energy and accordingly remain much cooler than the food product during microwave heating. Accordingly, the bottom portions of the food product which are in contact with the cool container remain cooler and have a tendency to absorb condensing water vapor. There have been attempts to minimize the degree of contact between the food product and the bottom of the container in order to prevent the food product from becoming soggy during microwave heating. See for example U.S. Pat. No. 4,355,757 to Roccaforte.

Others have attempted to improve the heating of microwavable food products through the use of a container made with microwave interactive material that converts microwave energy into thermal energy. Typically these containers utilize one or more microwave interactive "heater boards" positioned beneath and/or above the food product. In most cases the food product sits directly on the heater board surface which acts to brown the food product by conduction (i.e., contact) heating. Patents disclosing containers having a microwave interactive layer include U.S. Pat. Nos. 4,555,605 to Brown et al., 4,590,349 to Brown et al., 4,594,492 to Maroszek, and 4,190,757 to Turpin et al.

Unfortunately, these prior art microwave heating containers have not completely eliminated the problem of breaded food product sogginess caused by condensing water vapor during microwave heating. For example, the microwave interactive materials begin to cool immediately after the microwave heating stops. Thus, those parts of the food product which are in contact with the microwave interactive material also begin to cool. Any water vapor in the oven then has a tendency to condense on these cooling parts, leaving them soggy. In addition, these containers sometimes cause overcooking of the parts of the food which are in direct contact with the heater boards. In cases where the container also includes metal-containing microwave shielding for regulating the amount of microwave energy admitted into the container (see for example U.S. Pat. No. 4,190,757), there have been problems with fires caused by microwave arcing.

It is accordingly an object of the invention to provide a microwave heating method and a package assembly which serves as the primary retail package and container for microwave heating of breaded or battered food products, which substantially eliminates the problem of the breaded surface portions becoming soggy, and which provides enhanced crisping of the breaded or battered portions without the attendant problems of overcooking and microwave arcing.

The prior art containers have also suffered from the disadvantage of being difficult to manufacture and/or involve complicated steps for the consumer to follow in order to ready the product for microwave heating.

It is accordingly another object of the present invention to provide a package assembly for a microwave-compatible food product that is easy to manufacture and convenient for the consumer to use.

SUMMARY OF THE INVENTION

These and other important objects of the invention are provided by a method of microwave heating a breaded or battered food product and a package assembly in which this method can be carried out.

In its broadest form the package of this invention comprises a container for holding a food product, which container is adapted to provide an external air flow path over and around the food product, by means of air inlet and outlet openings therein. The outlet openings are preferably provided in the top of the container and the inlet openings are preferably provided in at least one other face of the container, most preferably the bottom. At least a portion of the container comprises a microwave interactive material. The microwave interactive material is provided over a sufficient portion of the container to raise the temperature of the air in the container to above about 100° C., and preferably in the range of about 150° to 200° C., during microwave heating and to create convective hot air currents along the external air flow path sufficient to heat the food product surfaces by convection. The container is also provided with a support means which minimizes contact of the food product with both the internal surface of the container and the support means itself.

The preferred package is an assembly including an internal container and a sleeve into which the container is insertable. The container holds the food product and has at least one inlet air opening in a bottom surface thereof and at least one outlet air opening in the top surface thereof. The entire interior surface of the container is composed of a microwave interactive material. The container is provided with at least one member for supporting the food product within the container and which minimizes the degree of contact between the food product and the support member. The sleeve serves as a retail package surrounding the food product container prior to consumer use. The sleeve is removed from the container prior to microwave heating of the food product. The removed sleeve serves as a support base upon which the container is placed in order to elevate the container from a support surface of the microwave cooking oven. The sleeve allows air to flow into the container through the inlet air opening, over the food product and out of the container through the outlet air opening to aid in the removal of moisture from the food product during microwave heating.

The invention also comprises a method for preventing the surface of a moisture-containing food product from becoming soggy due to condensing water vapor generated during microwave heating. The method includes the steps of placing the food product in a microwave heating container, at least a portion of which comprises a microwave interactive material. The container has an external air flow path therethrough and the food product is supported within the container so as to minimize the degree of contact with the food product. The exposure of the microwave interactive material to microwave energy causes air within the container to become heated to a temperature above about 100° C., and preferably to within about 150° to 200° C., and to flow along the external air flow path and over the food product during microwave heating. The hot air flowing over the food product convectively heats the surface of the food product and thereby prevents water vapor from condensing thereon and/or aids in moisture removal therefrom by evaporation.

DETAILED DESCRIPTION

Figure 1:
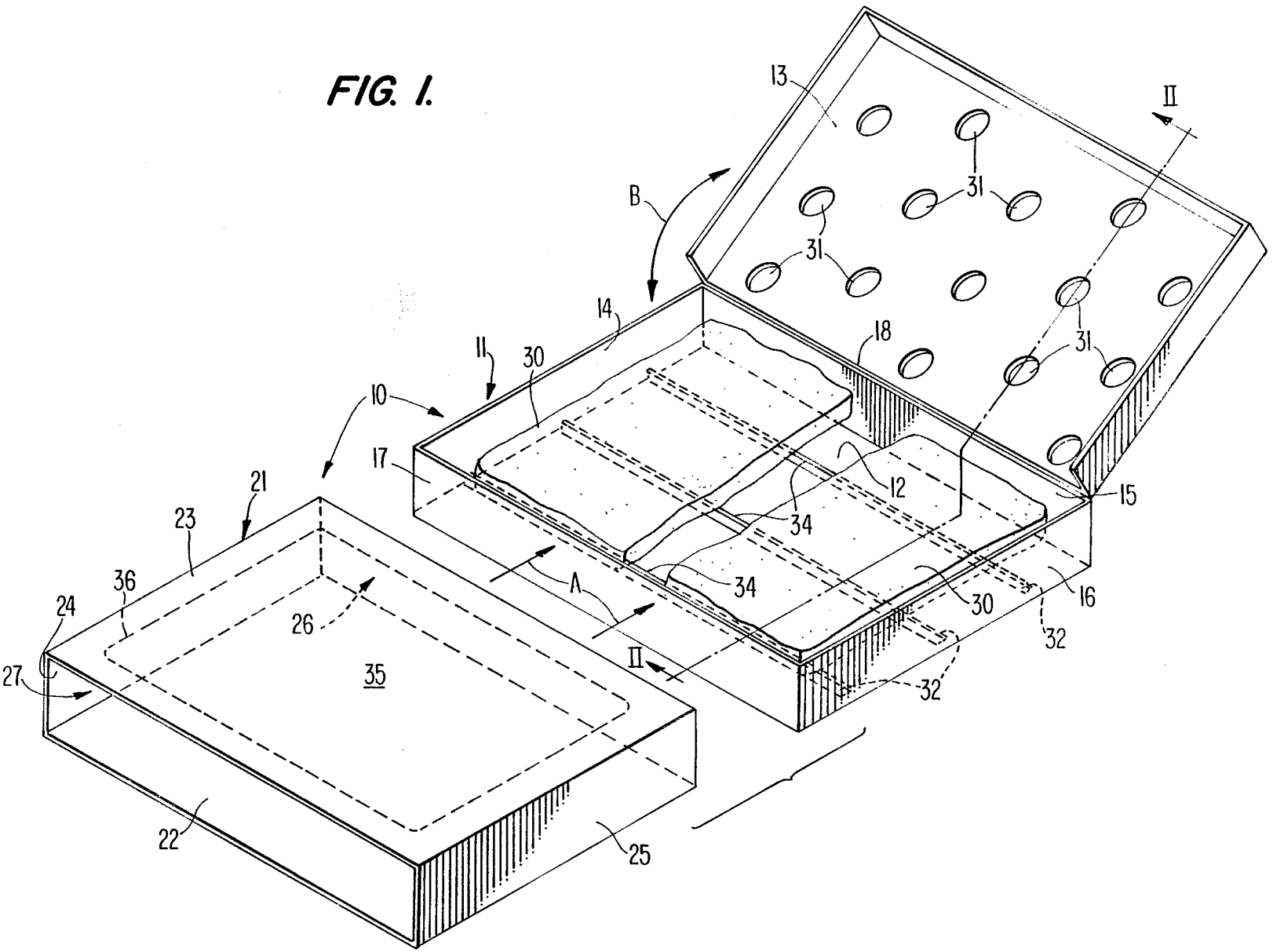
FIG. 1 is a perspective view of a package assembly, with the food product container removed from the sleeve, according to one embodiment of the invention.

Referring to the drawings, wherein like reference numerals refer to like elements in the several drawings, and especially referring to FIG. 1, there is illustrated a preferred package assembly 10 which comprises a food product container 11 and a packaging sleeve 21. Food product 30 can be placed in container 11 at the production facility and isolated from atmospheric contact by inserting it into sleeve 21 which can serve as the primary retail container. Container 11 and sleeve 21 may be composed of any number of materials which are suitable for contact with food and which are microwave transparent. Examples of suitable materials include paper, molded cellulosic fiber, cardboard, paperboard, plastic, glass and ceramic. A preferred material from a cost standpoint is SBS (solid bleached sulfate) paper.

Package assembly 10 may also be sealed with a conventional film material having the proper combination of strength and gas barrier properties for the particular packaging need. Upon opening the package assembly 10, container 11 simply slides out of the sleeve 21 in the direction of arrows A.

In the embodiment illustrated in the drawings, container 11 has a size and shape adapted to contain the food product 30. Containers having shapes and sizes other than that illustrated in the figures may also be used. Container 11 comprises a bottom panel 12, a top panel 15 and side panels 14, 15, 16 and 17. Top panel 13 is hinged to side panel 15 by fold line 18 in order to provide easy access to the food product 30 in container 11. Top panel 13 moves in the direction of arrow B.

The interior surface of container 11 is composed of a microwave interactive material which converts a substantial portion of the microwaves which impinge upon it to heat. One example of a microwave interactive material is a metalized layer of polyester film which may be adhered to the interior surface of container 11. Microwave interactive materials that may be used include those disclosed in U.S. Pat. No. 4,190,757, the disclosures of which are incorporated herein by reference. While it is preferred to provide the microwave interactive material over the entire interior surface of container 11 to achieve maximum heating of air in the container, it is of course possible to include areas within the container 11 which do not contain a microwave interactive layer. In addition, the microwave interactive material may be provided in an interior layer of the container material. Those skilled in the art will be able to determine the necessary amount of microwave interactive material to use in container 11 based on considerations such as container size and shape, the amount and type of food being heated, the size, shape, number and configuration of openings in the container, the power rating of the microwave oven, the positioning of the microwave interactive material within the container walls and the conversion efficiency of the particular microwave interactive material utilized. In any event, a sufficient amount of microwave interactive material should be provided in order to enable the container 11 to heat ambient air therein to a temperature of at least about 100° C., and preferably within the range of about 150° to 200° C., during microwave heating. Preferably, substantially all of the areas of the internal surface of the container which do not contact the food are coated with microwave interactive material. The microwave interactive internal surface of the food container 11 facilitates the hereinafter described convective heating of the food product surface, unlike the heater board browning by conduction heating employed in the prior art.

In the embodiment illustrated in the drawings, sleeve 21 has a size and shape so as to preferably provide a close sliding fit around container 11. Sleeve 21 comprises a bottom panel 22, a top panel 23 and side panels 24, 25. Top panel 23 has a detachable portion 35 defined by a weakened or perforated line 36. Sleeve 21 is preferably provided with at least one open or openable side. In the embodiment illustrated in the figures, sleeve 21 has two open sides 26 and 27. The openings may be provided through the use of one or more detachable side panels (not shown) which may be removed prior to removing container 11 from sleeve 21.

Sleeve 21 may of course have other shapes and/or configurations than that illustrated in the drawings. For instance, sleeve 21 may be replaced with any standard outer container adapted to contain one or more inner containers 11 and which inner containers are provided with an open side and a detachable or other opening in its top surface. In addition, sleeve 21 may be made with both ends open so that the sleeve may be easily collapsed into a substantially flattened condition. The flattened sleeve may then be detachably attached to, or enclosed in, container 11 in the flattened condition. In both of these variations the sleeve is still used as a microwave heating stand for container 11, as will be described in more detail hereinafter.

Figure 2:
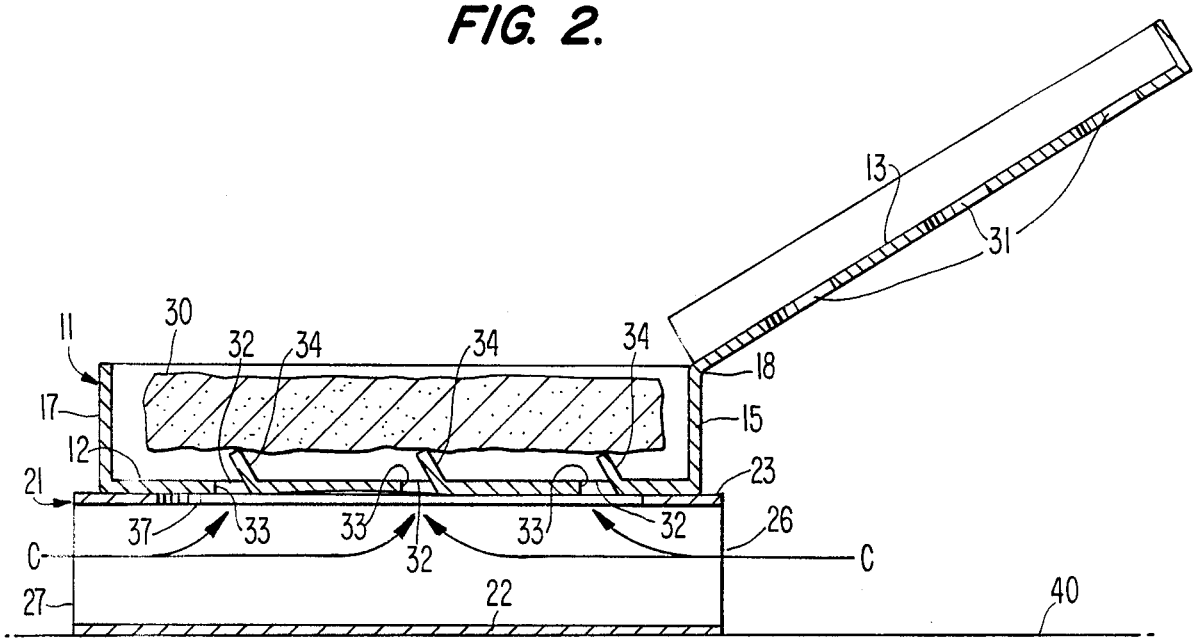
FIG. 2 is a side sectional view of the food product container shown in FIG. 1 and taken along the II—II, shown resting on top of the sleeve shown in FIG. 1.

Referring now to FIGS. 1 and 2, bottom panel 12 is provided with a plurality of inlet air openings 32. In the embodiment illustrated in the drawings, inlet openings 32 are formed by making a plurality of U-shaped slits 33 in bottom panel 12. Each of the U-shaped slits 33 defines a tab 34 which is bent upwardly out of the plane of bottom panel 12 as is most clearly shown in FIGS. 2 and 3. Tabs 34 form a support member which is effective to support food product 30 off of bottom panel 12. Tabs 34 provide "line" support for food product 30 and greatly minimize the degree of contact between food product 30 and container 11. Separate means for supporting food product 30 off of bottom panel 12, while minimizing the degree of contact between the support and the food product 30 may also be used. For example, container 11 may be provided with a food product supporting element comprising a plurality of parallel lateral elements and a plurality of parallel transverse elements, each of the lateral elements interlocking with all of the transverse elements, and each of the transverse elements interlocking with all of the lateral elements, and having a configuration similar to the divider in an ice cube tray. Such a support element provides lateral and transverse "line" support for food product 30 and accordingly minimizes the degree of contact between food product 30 and the support element. This kind of support member can be made from a plurality of strips that are assembled at the processing facility and inserted under the food product, or packaged in a flattened condition for set up by the consumer or even made as an inserted or insertable one-piece molded article. Another support means which may be used with food products having a generally elongated cylindrical shape, such as breaded fish sticks, comprises a plurality of parallel dividers within container 11, each divider having a number of cut out openings for holding a number of the cylindrically shaped food products therein. Other support means well known to those skilled in the art may also be used.

Top panel 13 has a plurality of outlet air openings 31 therein. Openings 31 are preferably round, whereas openings 32 are preferably rectangular slots. Since microwave energy passes through rectangular slots more easily than through round openings, there is a somewhat higher degree of heating of the bottom portion of food product 30 where sogginess is most likely to occur. Conversely the preferred round openings in the top of the container promote a higher degree of cooking by convection than by direct microwave heating of the food.

The number, shape and size of inlet openings 32 and outlet openings 31 may be determined, as will be appreciated by those skilled in the art, to provide free air flow through container 11 and to allow a sufficient quantity of microwave energy to pass into the container and thereby heat the food product. Container 11 preferably contains no microwave reflecting or "shielding" layers.

Figure 3:
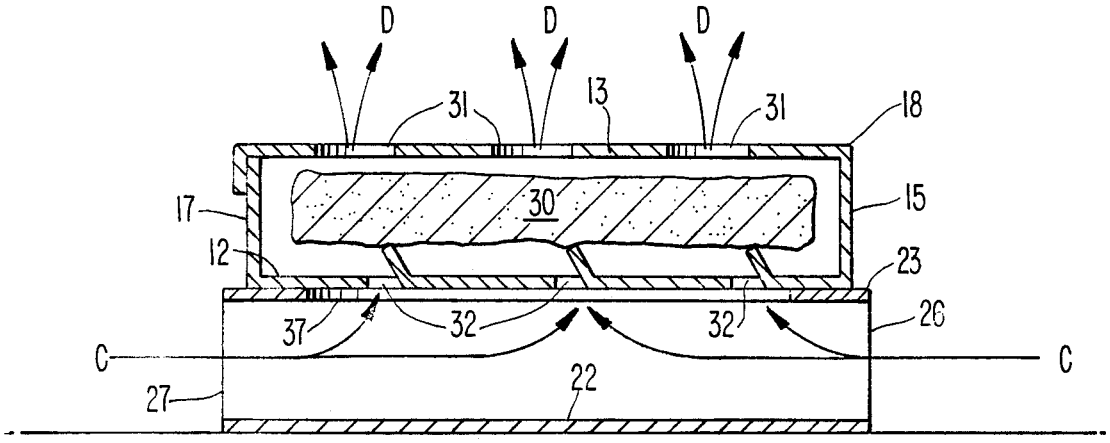
FIG. 3 is a side sectional view of the container and sleeve shown in FIG. 1, with the container closed.

In order to prepare food product 30 for microwave heating, container 11 is first removed from sleeve 21. Detachable portion 35 is then removed from the top panel 23 of sleeve 21. The sleeve 21 is then placed on the support surface 40 of a microwave oven oriented in such a way that opening 37 (formed by removing detachable portion 35) is in the upper surface of the sleeve. Sleeve 21 thereby forms a microwave heating stand for container 11. As shown in FIG. 3, container 11 is simply placed, in a closed condition, on top of sleeve 21. When embodiments not employing a sleeve are utilized, the heating stand function, if necessary, can be provided by separate supports means or even means integral with the inner container such as molded feet, or tabs which can be folded out to provide feet.

The combination of open sides 26 and 27, opening 37, inlet air openings 32 and outlet air openings 31 provide a generally vertical external air flow pathway through container 11 and over food product 30 as shown by arrows C and D. Of course, alternate flow paths may be provided through container 11 by varying the positioning of the openings 31, 32. For instance, inlet air openings 32 may be provided in side panels 15 and/or 17 rather than in bottom panel 12 as is illustrated in the figures. In such an embodiment, the air enters container 11 through the sides of the container, flows over the food product 30 and out through the air outlet openings 31. This alternative embodiment does not require the use of a microwave heating stand since the inlet air openings 32 remain uncovered even when the bottom of container 11 rests directly on microwave support surface 40. Accordingly, those skilled in the art will appreciate that the microwave heating stand/sleeve 21 comprises a preferred embodiment of the present invention having particular utility when inlet air openings 32 are provided in the bottom surface of container 11.

Food product 30 may be any food product but this invention is particularly well suited to the heating of high moisture products. Examples of food products which can be microwave-heated in the package assembly 10 include both frozen and unfrozen food products. Frozen food products which are coated with a batter (i.e., water and flour) or coated with bread crumbs or coated with a combination of a batter and bread crumbs may be used to particular advantage with the package assembly 10 of the present invention. Examples of specific food products include breaded or battered fish fillets, breaded or battered fish sticks, breaded or battered chicken fingers, breaded or battered chicken fillets, sandwiches, pizzas, pies, battered or breaded cheeses and vegetables, and the like.

In the configuration illustrated in FIG. 3 with container 11 resting on top of sleeve 21, and sleeve 21 resting on a support surface 40 of a microwave oven, the food product 30 is ready for microwave heating. Microwave heating may be conducted in any conventional microwave oven. One of ordinary skill in the art will be able to determine the optimum combination of heating times and temperatures for any particular food product. As an example, when heating six fish sticks in the package assembly shown in the figures, a microwave oven having a power rating of 650 watts, can be optimally employed for a period of about 2 to 2½ minutes, generally followed by a cooling period of about 2 minutes. The microwave heating of food product 30 causes the water therein to become vaporized. In addition, the interior surface of container 11 absorbs microwave energy and converts it to thermal energy, thereby heating the ambient air within container 11 to a temperature above 100° C. This heated air flows over the food product 30 causing its surface to be heated by convection. Accordingly, the microwave heating containers of the present invention are inherently different in their mode of operation from the prior art heating containers utilizing microwave interactive heater boards which directly contact the food products being heated. In these prior art containers, the microwave interactive heater boards functioned similarly to a hot griddle, whereby the food product is browned by directly contacting the surface of the heater board. On the other hand, the container of the present invention heats food product 30 by convection heating, i.e., by causing heated air to flow over the surface of food product 30.

The heated air has a natural tendency to rise and is accordingly vented out of openings 31 in the direction of arrows D. The heated air flowing out of openings 31 carries any water vapor generated by the microwave heating of food product 30 out of container 11 through openings 31. The heated air flow over the surface of food product 30 also causes the surface to become relatively hotter, thereby preventing water vapor from condensing thereon and enhancing crisping of food product 30. In the case of meat products such as fish and chicken fillets having a breaded coating, the package assembly 10 is effective to prevent the breaded coating from becoming soggy. The hot gases exiting outlet air openings 31 cause air to be drawn in the direction of arrow C from the sleeve 21 through the inlet openings 32. The air drawn into container 11 is then heated by the microwave interactive interior surface of container 11. The heated air rises and flows over the food product 30 and out of the air outlet openings 31. In this manner, a generally vertical air flow pathway is formed through container 11 and over the food product 30.

The term "external air flow path" as used in the specification and claims denotes an air flow path beginning at a point outside of the container, entering the container through an air inlet opening therein, running through the container and past the food product, existing the container through an air outlet opening therein, and ending at a point outside of the container. The air outlet opening should be positioned at a higher level on the container than the air inlet opening in order to form an upwardly rising air flow path. Preferably the air inlet opening is provided in the bottom of the container and the air outlet opening is provided in the top of the container, thereby forming a generally vertical air flow path through the container. While a generally vertical external air flow path, such as that illustrated in the figures, is preferred, other external air flow paths having other air inlet and air outlet configurations may also be utilized. Those skilled in the art will appreciate that microwave heating containers which are essentially closed to the exterior atmosphere or only having vent openings in one surface thereof may exhibit air currents or eddies caused by the microwave heating of the food product. These containers do not, however, utilize "external air flow paths" as that term is defined herein.

EXAMPLE

A package assembly having a construction substantially as shown in the figures was used to heat six breaded frozen fish sticks. Each of the fish sticks had a weight of approximately 28 gms and a moisture content of about 70–80%. The fish sticks had a battered and breaded coating composed of water, flour and bread crumbs. The coating comprised about 50% by weight of the coated fish sticks.

Both the container and sleeve portions of the package assembly were composed of solid bleached sulphate paper. The container had dimensions of 4"×6"×1" and a hinged top with fifteen round air outlet openings, each opening having a diameter of 7/16". The bottom of the container was provided with three U-shaped slits running substantially the entire length of the container. The U-shaped slits formed tabs having a length of about 6" and a height of approximately ¼". The fish fillets were arranged on the upwardly extending tabs so that the axis of the sticks was at 90° with respect to the lengthwise direction of the slits. The three slits provided openings in the bottom of the container having a total area of about 4.3 $in^2$. The fifteen openings in the top of the container provided a total outlet opening area of about 11.8 $in^2$.

The sleeve had a size and shape adapted to provide a close sliding fit around the container and was provided with two open ends. A detachable opening was formed by a perforated line in its top surface. The detactable portion of the sleeve was removed, thereby forming an opening having dimensions of about 3"×5". The container was placed in a closed condition on top of the sleeve (and over the 3"×5" opening) within a conventional microwave oven having a power rating of 650 watts. The oven was set on high and microwave heating was conducted for 2 minutes followed by a cooling period of 2 minutes.

The frozen fish sticks were removed from the container and carefully inspected for sogginess in the outer breaded coating. The outer coatings of all the fish sticks were completely dry and crisp to the touch and taste.

Although certain embodiments of the invention have been illustrated in the drawings, those skilled in the art will appreciate that a wide variety of equivalents may be substituted for those specific elements described and illustrated and that the scope of the invention should not be limited thereby but rather is defined in the appended claims.

I claim:

1. A package for a microwave-heatable food product comprising:

a container adapted to hold said food product and providing an external air flow path over and around the food product, at least a portion of the container comprising a microwave interactive material;

food support means within the container which minimize contact of the food product with both the container and the food support means;

wherein a sufficient amount of the microwave interactive material is provided in the container to raise the temperature of the air in the container to above about 100° C. and to create convective hot air currents along the external air flow path sufficient to heat the food product surface by convection.

2. A package assembly for a microwave-heatable food product comprising:

a container including at least one support member for supporting said food product in said container and minimizing contact between said food product and said support member and having at least one outlet air opening in one wall of said container, at least one inlet air opening in another wall of said container to form an external air flow path therethrough and being composed of a microwave interactive material;

a support base upon which said container can be placed to elevate said container off a support surface of a microwave cooking oven, said support base allowing air outside the container to flow along the external flow path, by entering the container through said inlet opening, become heated by the microwave interactive material and flow over said food product and out of said container through said outlet air opening to convectively heat said food product and aid in the removal of moisture from said food product during microwave heating.

3. The package assembly of claim 2 wherein said container is composed of a material selected from the group consisting of bleached paper, bleached cardboard, bleached paperboard, molded cellulosic fibers, plastic, glass and ceramic.

4. The package assembly of claim 2, wherein the support base comprises a sleeve which forms a package surrounding the container prior to consumer use, and removable from said container prior to microwave heating of said food product, the sleeve having a size and shape adapted to slidably engage the container.

5. The package assembly of claim 4, wherein the sleeve is composed of a material selected from the group consisting of paper, cardbard, paperboard, plastic, glass and ceramic.

6. The package assembly of claim 4, wherein the sleeve has at least one open side.

7. The package assembly of claim 2, wherein the inlet opening is provided in the bottom of the container and the outlet opening is provided in the top of the container.

8. The package assembly of claim 6, wherein the removed sleeve has an opening therein which opening is adjacent the inlet air opening in the bottom of the container.

9. The package assembly of claim 2, wherein the support member comprises an integral part of the bottom of the container.

10. The package assembly of claim 10, wherein the support member comprises a plurality of tabs bent upwardly out of the plane of the bottom of the container.

11. The package assembly of claim 2, wherein the container has a plurality of inlet air openings.

12. The package assembly of claim 2, wherein the container has a plurality of outlet air openings.

13. A package assembly for a microwave-heatable breaded food product comprising a container having a bottom panel with a plurality of U-shaped slits therein, each of said slits defining a tab which is upwardly displaced out of the plane of the bottom panel thereby forming a plurality of inlet air openings, the plurality of tabs supporting the food product above the bottom panel with minimal contact between the food product and the container, the container also having side panels extending vertically from the bottom panel to a top panel hingedly connected to a side panel forming a hinged opening to the container, the top panel having an outlet air opening therein and the container having an interior surface composed of a microwave interactive material, and a sleeve adapted to surround the container during retail display thereof, the container adapted to be removed from, and placed on, the sleeve prior to microwave heating of the food product, the sleeve having bottom, top and side panels corresponding with the bottom, top and side panels of the container, a portion of the sleeve top panel being detachable to form an opening therein, the sleeve having an opening in at least one side panel thereof, said container being adapted to rest on the sleeve top panel after removal of the detachable portion therefrom, wherein the combination of (i) the sleeve side panel opening, (ii) the sleeve top panel opening, (iii) the inlet air openings and (iv) the outlet air opening, form a vertical air flow pathway through the sleeve and the container.

14. A method of preventing the surface of a high moisture food product from becoming soggy during microwave heating thereof, comprising:

placing the food product in a microwave heating container at least partially comprising a microwave interactive material and having an external air flow path therethrough;

supporting the food product within the container with minimal contact between the food product and the container; and exposing the food product and the microwave interactive material to microwave energy, the exposure of the microwave interactive material causing the container to become heated and thereby causing air within the container to become heated and to flow along the external air flow path and over the food product during said microwave exposure, said hot air flow convectively heating the surface of the food product.

15. The method of claim 14, wherein the food product is a breaded meat product.

16. The method of claim 15, wherein the breaded meat product is selected from fish fillets and fish sticks.

17. The method of claim 14, wherein the air inside the container is heated to a temperature of at least about 100° C. during said microwave heating.

18. The method of claim 17, wherein the air inside the container is heated to a temperature in the range of about 150° C. to 200° C. during said microwave heating.

19. A package assembly for a microwave-heatable food product comprising:

a container having an inlet air opening in a bottom panel thereof, a food supporting element for supporting the food product above the bottom panel with minimal contact between the food product and the food supporting element, the container also having side panels extending vertically from the bottom panel to a top panel hingedly connected to a side panel forming a hinged opening to the container, the top panel having an outlet air opening therein, at least one of the container panels being comprised of a microwave interactive material, and container support means for supporting the container above a floor in a microwave oven, the container support means allowing air outside the container to enter the container through the inlet air opening and become heated by the microwave interactive material, the combination of (i) the inlet air opening, (ii) space enclosed by the container and (iii) the outlet air opening, forming a vertical air flow pathway through the container for convective heating of a microwave-heatable food product placed therein.

* * * * *